US011638081B2

(12) United States Patent
Bacon et al.

(10) Patent No.: US 11,638,081 B2
(45) Date of Patent: Apr. 25, 2023

(54) EARPHONE PORT

(71) Applicant: Bose Corporation, Framingham, MA (US)

(72) Inventors: Cedrik Bacon, Ashland, MA (US); Mark McCauley, Brighton, MA (US); Donna M. Sullivan, Millbury, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 17/467,187

(22) Filed: Sep. 4, 2021

(65) Prior Publication Data

US 2023/0070372 A1 Mar. 9, 2023

(51) Int. Cl.
*H04R 1/10* (2006.01)

(52) U.S. Cl.
CPC ..... *H04R 1/1016* (2013.01); *H04R 2460/11* (2013.01)

(58) Field of Classification Search
CPC ..... H04R 1/1016; H04R 1/28; H04R 1/2803; H04R 1/2807; H04R 1/2811; H04R 1/2815; H04R 1/2819; H04R 1/2823; H04R 1/2826; H04R 1/2838; H04R 1/2842; H04R 1/2846; H04R 1/2849; H04R 1/2853; H04R 1/2857; H04R 1/2861; H04R 1/2865; H04R 2460/11
See application file for complete search history.

(56) References Cited

U.S. PATENT DOCUMENTS 4,742,887 A * 5/1988 Yamagishi ..... H04R 1/22 381/372
4,981,194 A * 1/1991 Kamon ..... H04R 1/1016 181/158
6,738,487 B1 * 5/2004 Nageno ..... H04R 1/1016 381/322

(Continued)

FOREIGN PATENT DOCUMENTS

CN 204 146 762 U 2/2015
CN 110 149 566 A 8/2019

(Continued)

OTHER PUBLICATIONS

International Search Report and the Written Opinion of the International Searching Authority, dated Dec. 20, 2022 in PCT/US2022/042564, filed Sep. 5, 2022.

*Primary Examiner* — Ryan Robinson
(74) *Attorney, Agent, or Firm* — Bose Corporation

(57) ABSTRACT

A port tube for an earphone, wherein the port tube is configured to acoustically couple a rear acoustic cavity of the earphone to an external environment, includes a first section that is proximate the rear cavity and defines a first cross-sectional area, a second, transitional, section that is coupled to the first section and defines a gradually increasing cross-sectional area, a third, curved and banked, section that is coupled to the second section and defines a second cross-sectional area that is greater than the first cross-sectional area, a fourth, transitional, section that is coupled to the third section and defines a gradually decreasing cross-sectional area, and a fifth section that is coupled to the fourth section and defines a third cross-sectional area that it less than the second cross-sectional area.

20 Claims, 8 Drawing Sheets

(56) References Cited

U.S. PATENT DOCUMENTS

| | | | | |
|---|---|---|---|---|
| 8,422,717 | B2 * | 4/2013 | Lin | H04R 1/1091 381/372 |
| 8,532,325 | B2 * | 9/2013 | Tung | H04R 1/2811 381/338 |
| 8,670,586 | B1 * | 3/2014 | Boyle | H04R 1/2826 381/189 |
| 8,750,552 | B2 * | 6/2014 | Barinaga | H04R 1/2823 381/357 |
| 8,976,994 | B2 * | 3/2015 | Howes | H04R 1/2807 381/370 |
| 9,363,594 | B2 * | 6/2016 | Azmi | H04R 1/2807 |
| 9,578,412 | B2 * | 2/2017 | Azmi | H04R 1/2826 |
| 9,591,398 | B1 * | 3/2017 | Wang | H04R 1/2819 |
| 9,621,977 | B2 * | 4/2017 | Hu | H04R 1/1058 |
| 9,838,777 | B2 * | 12/2017 | Kuwahara | H04R 1/1041 |
| 9,854,345 | B2 | 12/2017 | Briggs | |

FOREIGN PATENT DOCUMENTS

| | | |
|---|---|---|
| CN | 209 930 502 U | 1/2020 |
| CN | 213 342 624 U | 6/2021 |
| JP | 2016 195444 A | 11/2015 |

* cited by examiner

EARPHONE PORT

BACKGROUND

This disclosure relates to a port for earphones.

Earphone mass ports should maintain airflow even at low frequencies.

SUMMARY

Aspects and examples are directed to a mass port for an earphone with an increased diameter and length that is effective to support airflow even at frequencies as low as 2-6 Hz.

All examples and features mentioned below can be combined in any technically possible way.

In one aspect, a port tube for an earphone, wherein the port tube is configured to acoustically couple a rear acoustic cavity of the earphone to an external environment, includes a first section that is proximate the rear cavity and defines a first cross-sectional area, a second, transitional, section that is coupled to the first section and defines a gradually increasing cross-sectional area, a third, curved and banked, section that is coupled to the second section and defines a second cross-sectional area that is greater than the first cross-sectional area, a fourth, transitional, section that is coupled to the third section and defines a gradually decreasing cross-sectional area, and a fifth section that is coupled to the fourth section and defines a third cross-sectional area that it less than the second cross-sectional area.

Some examples include one of the above and/or below features, or any combination thereof. In some examples the first section is curved. In an example a radius of curvature of a central longitudinal axis of the first section is approximately the same as a radius of curvature of the central longitudinal axis of the third section. In an example the second and fourth sections each transition approximately the same amount in cross-sectional area.

Some examples include one of the above and/or below features, or any combination thereof. In an example the third section comprises an inner wall and an outer wall, and the banking is between the inner wall and the outer wall. In an example the third section further comprises a lower wall that meets the inner wall and the outer wall. In an example the banking comprises the inner wall being longer than the outer wall. In an example the banking comprises the inner wall having a length that is about 20 percent greater than that of the outer wall.

Some examples include one of the above and/or below features, or any combination thereof. In an example the fifth section is curved. In an example a radius of curvature of a central longitudinal axis of the fifth section is smaller than is a radius of curvature of a central longitudinal axis of the third section. In an example the port tube is generally "S"-shaped along a length thereof between a first end where the port tube is fluidly coupled to the rear acoustic cavity of the earphone and a second end where the port tube is fluidly coupled to the external environment. In an example the "S"-shape defines a first curve closest to the first end and a second curve closest to the second end. In an example the first curve has a radius of curvature of a central longitudinal axis of the port tube that is greater than a radius of curvature of a central longitudinal axis of the second curve of the port tube.

Some examples include one of the above and/or below features, or any combination thereof. In an example the second cross-sectional area is approximately 12 percent greater than the first cross-sectional area. In an example the tube has a length dimension along its length and a width dimension across its width that is orthogonal to its length, and wherein the width dimension is approximately the same along the entire length dimension. In an example the first, third, and fifth sections each have a constant cross-sectional area along lengths thereof. In an example the cross-sectional areas of the first and fifth sections are the same, and the cross-sectional area of the third section is greater than that of the first and fifth sections.

In another aspect a port tube for an earphone, wherein the port tube is configured to acoustically couple a rear acoustic cavity of the earphone to an external environment, includes a first, curved, section that is proximate the rear cavity and defines a first cross-sectional area, a second, transitional, section that is coupled to the first section and defines a gradually increasing cross-sectional area, a third, curved and banked, section that is coupled to the second section and defines a second cross-sectional area that is greater than the first cross-sectional area, and comprising an inner wall, an outer wall, and a lower wall that meets the inner wall and the outer wall, and wherein the banking comprises the inner wall having a length that is greater than a length of the outer wall, a fourth, transitional, section that is coupled to the third section and defines a gradually decreasing cross-sectional area, and a fifth, curved, section that is coupled to the fourth section and defines a third cross-sectional area that it less than the second cross-sectional area. The second and fourth sections each transition approximately the same amount in cross-sectional area. The tube has a length dimension along its length and a width dimension across its width that is orthogonal to its length, and the width dimension is approximately the same along the entire length dimension. The first, third, and fifth sections each have a constant cross-sectional area along lengths thereof, the cross-sectional areas of the first and fifth sections are the same, and the cross-sectional area of the third section is greater than that of the first and fifth sections.

Some examples include one of the above and/or below features, or any combination thereof. In an example a radius of curvature of a central longitudinal axis of the fifth section is smaller than is a radius of curvature of a central longitudinal axis of the third section. In an example the second cross-sectional area is approximately 12 percent greater than the first cross-sectional area.

BRIEF DESCRIPTION OF THE DRAWINGS

Various aspects of at least one example are discussed below with reference to the accompanying figures, which are not intended to be drawn to scale. The figures are included to provide illustration and a further understanding of the various aspects and examples, and are incorporated in and constitute a part of this specification, but are not intended as a definition of the limits of the inventions. In the figures, identical or nearly identical components illustrated in various figures may be represented by a like reference character or numeral. For purposes of clarity, not every component may be labeled in every figure. In the figures.

DETAILED DESCRIPTION

Figure 1:
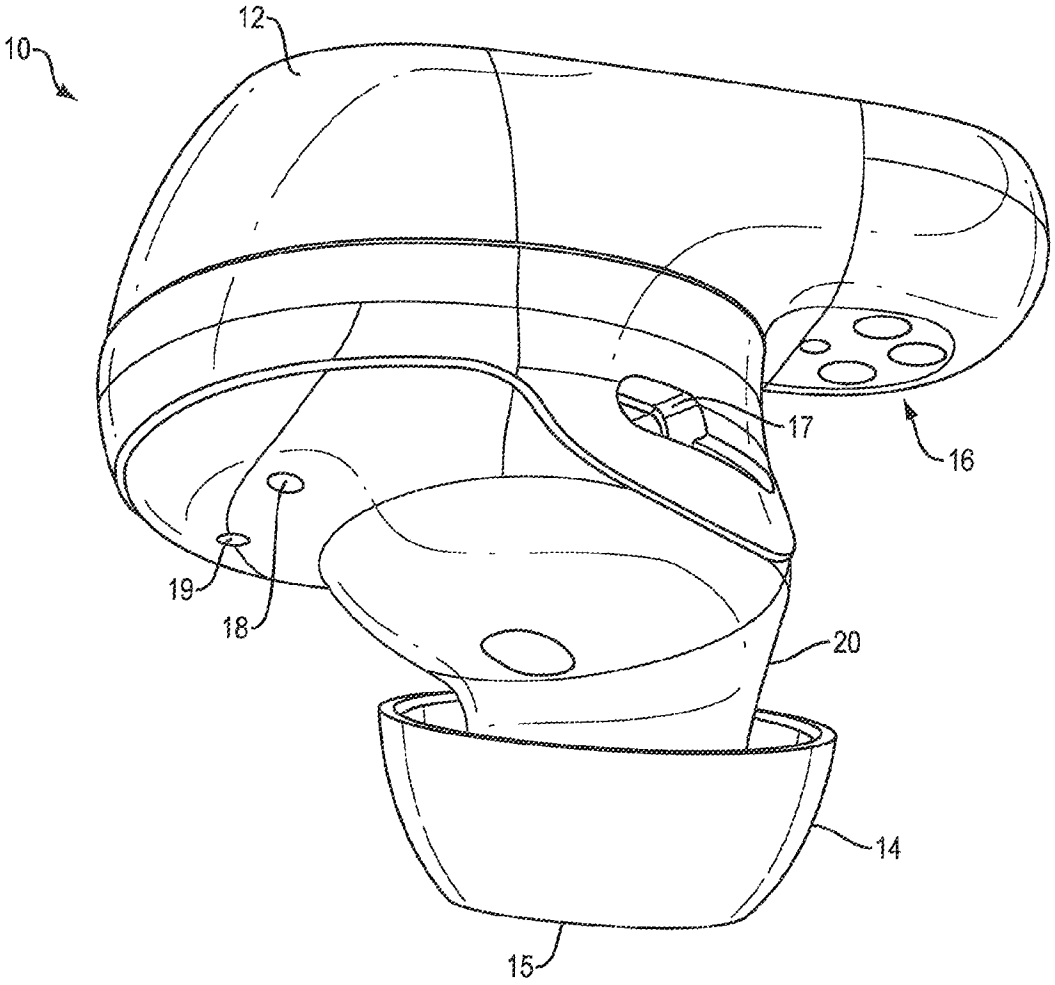
FIG. 1 is a perspective view of an earphone.

In examples of the present disclosure a port tube for an earphone is configured to provide for effective airflow, even at very low frequencies. This is accomplished at least in part with a tube that includes a first section that is proximate the rear cavity of the earphone and has a first cross-sectional area, a second, transitional, section that is coupled to the first section and defines a gradually increasing cross-sectional area, a third, curved and banked, section that is coupled to the second section and defines a second cross-sectional area that is greater than the first cross-sectional area, a fourth, transitional, section that is coupled to the third section and defines a gradually decreasing cross-sectional area, and a fifth section that is coupled to the fourth section and defines a third cross-sectional area that it less than the second cross-sectional area.

Examples of the systems, methods and apparatuses discussed herein are not limited in application to the details of construction and the arrangement of components set forth in the following description or illustrated in the accompanying drawings. The systems, methods and apparatuses are capable of implementation in other examples and of being practiced or of being carried out in various ways. Examples of specific implementations are provided herein for illustrative purposes only and are not intended to be limiting. In particular, functions, components, elements, and features discussed in connection with any one or more examples are not intended to be excluded from a similar role in any other examples.

Examples disclosed herein may be combined with other examples in any manner consistent with at least one of the principles disclosed herein, and references to "an example," "some examples," "an alternate example," "various examples," "one example" or the like are not necessarily mutually exclusive and are intended to indicate that a particular feature, structure, or characteristic described may be included in at least one example. The appearances of such terms herein are not necessarily all referring to the same example.

Also, the phraseology and terminology used herein is for the purpose of description and should not be regarded as limiting. Any references to examples, components, elements, acts, or functions of the computer program products, systems and methods herein referred to in the singular may also embrace embodiments including a plurality, and any references in plural to any example, component, element, act, or function herein may also embrace examples including only a singularity. Accordingly, references in the singular or plural form are not intended to limit the presently disclosed systems or methods, their components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms.

Some examples of this disclosure describe a type of wearable audio device that is known as an earphone, a headphone, a headset, or an earbud. These devices generally deliver sound into a closed or partially-closed volume in the outer ear. Earbuds generally deliver sound directly into the user's ear canal.

The term headphone is often used to refer to a device that typically fits around, on, or in an ear and that radiates acoustic energy directly or indirectly into the ear. Headphones are sometimes referred to as earphones, earpieces, headsets, earbuds, or sport headphones, and can be wired or wireless. A headphone includes an electro-acoustic transducer (driver) to transduce electrical audio signals to acoustic energy. The acoustic driver may or may not be housed in an earcup. A headphone may be a single stand-alone unit or one of a pair of headphones (each including at least one acoustic driver), one for each ear. A headphone may be connected mechanically to another headphone, for example by a headband and/or by leads that conduct audio signals to an acoustic driver in the headphone. A headphone may include components for wirelessly receiving audio signals. A headphone may include components of an active noise reduction (ANR) system. Headphones may also include other functionality, such as a microphone.

It should be noted that although specific implementations of wearable audio devices primarily serving the purpose of acoustically outputting audio are presented with some degree of detail, such presentations of specific implementations are intended to facilitate understanding through provisions of examples and should not be taken as limiting either the scope of the disclosure or the scope of the claim coverage.

FIG. 1 is a perspective view of a wireless in-ear headphone or earbud, 10. An earbud is only one non-limiting example of an audio device with the subject port. Earbud 10 includes body or housing 12 that houses the active components of the earbud. Portion 14 is coupled to sound outlet nozzle 20 of body 12 and is pliable so that it can be inserted into the entrance of the ear canal. Sound is delivered through nozzle outlet opening 15. Battery charging contacts 16, resistive port opening 17, microphone opening 18, and mass port opening 19 are visible. Earbuds are well known in the field (e.g., as disclosed in U.S. Pat. No. 9,854,345, the disclosure of which is incorporated herein by reference), and so certain details of the earbud are not further described herein. An earbud 10 is an example of a wearable audio device according to this disclosure, but is not limiting of the scope of the disclosure as other types of earphones can use the subject port.

Figure 2A:
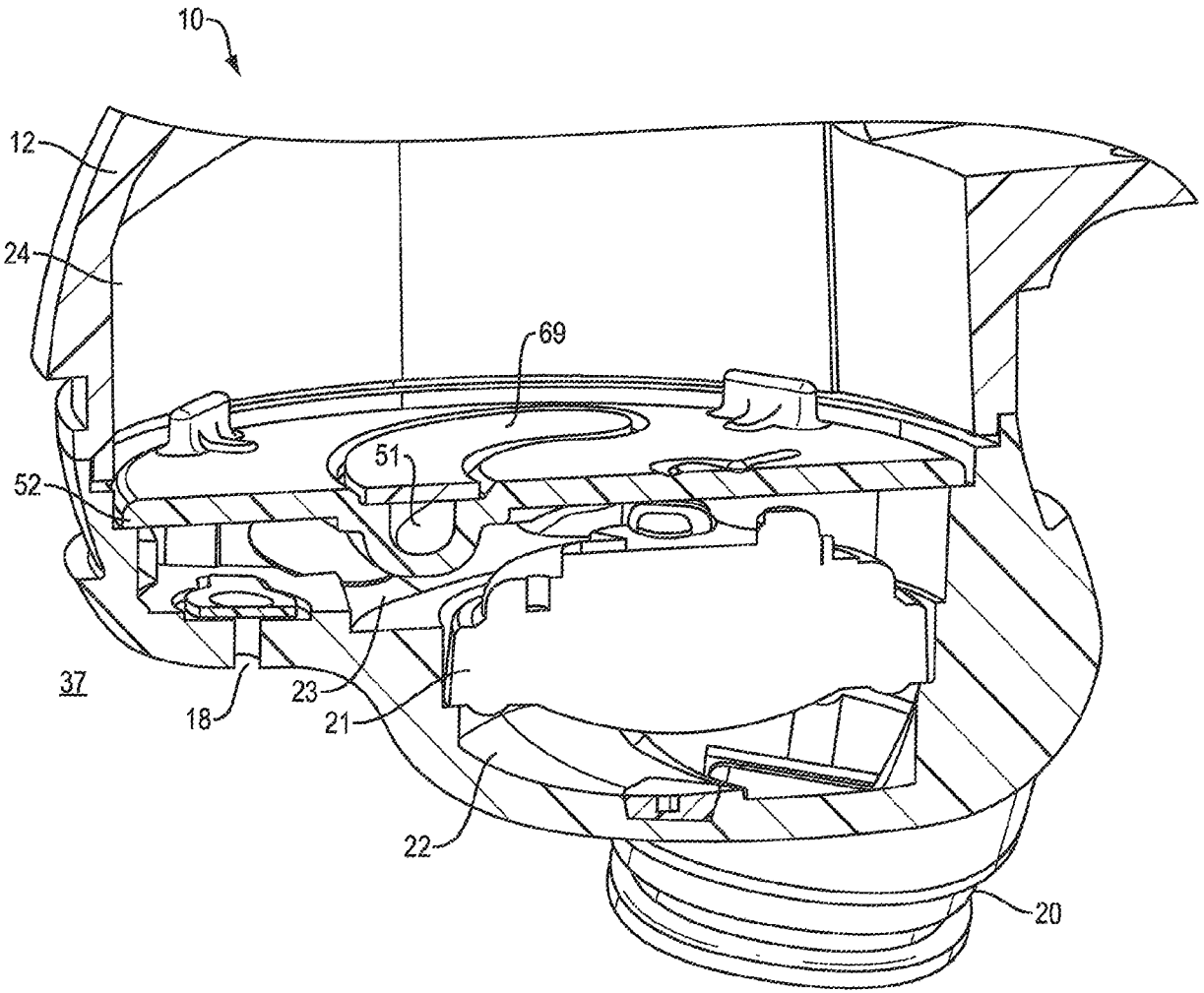
FIG. 2A is a cross-sectional view of an earphone.

FIG. 2A is a partial cross-sectional view of only certain elements of an earphone or earbud 10 that are useful to a better understanding of the present disclosure. Earbud 10 comprises housing 12 that encloses electro-acoustic transducer 21. Transducer 21 develops sound pressure in front acoustic cavity 22 and rear acoustic cavity 23. The sound in cavities 22 and 23 is out of phase. Sound from cavity 22 is delivered into nozzle 20 that is coupled to the user's ear canal (not shown) in a manner that is known in the technical field. In some examples cavity 22 includes a second outlet 17 (FIG. 1), which may be a resistive port of a type known in the technical field. A mass port defined in part by channel 51 in internal dividing plate 52, along with channel cover 69 that closes the top of channel 51, is open at one end to rear cavity 23 and at its other end is open to the external environment 37 outside of housing 12. Plate 52 is configured to divide the acoustics of the earphone from upper earphone cavity 24, which can house electronics, a battery, and other earbud components (not shown) of types known in the field. The mass port is a reactive port. In some examples a second rear resistive port (not shown) is also included. The resistive port can act in parallel with the reactive port. Reactive and resistive ports in earbuds are well known in the technical field and so are not further described herein. Microphone opening 18 is configured to conduct external sound to a microphone (not shown).

Figure 2B:
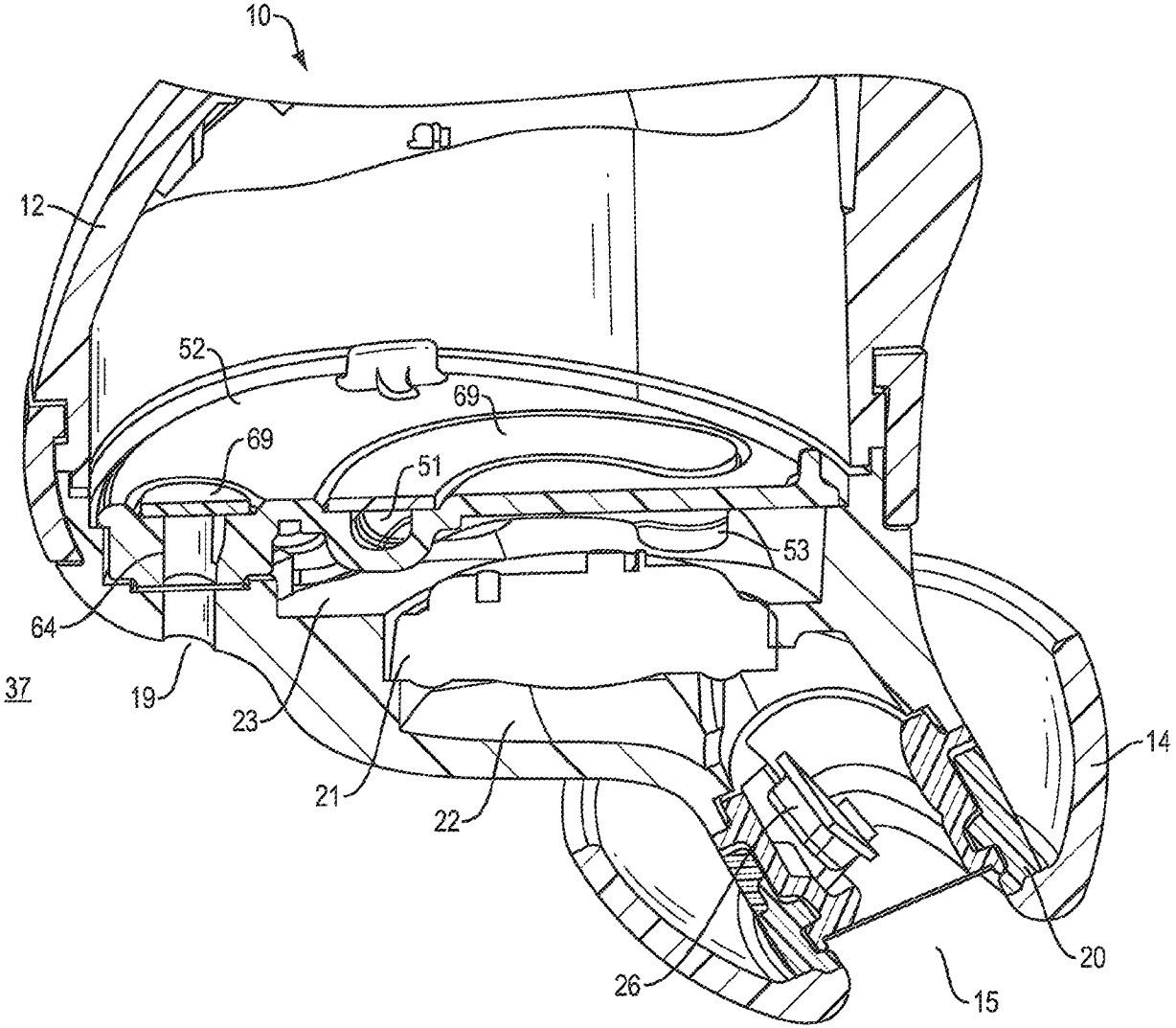
FIG. 2B is a cross-sectional view of an earphone.
Figure 2C:
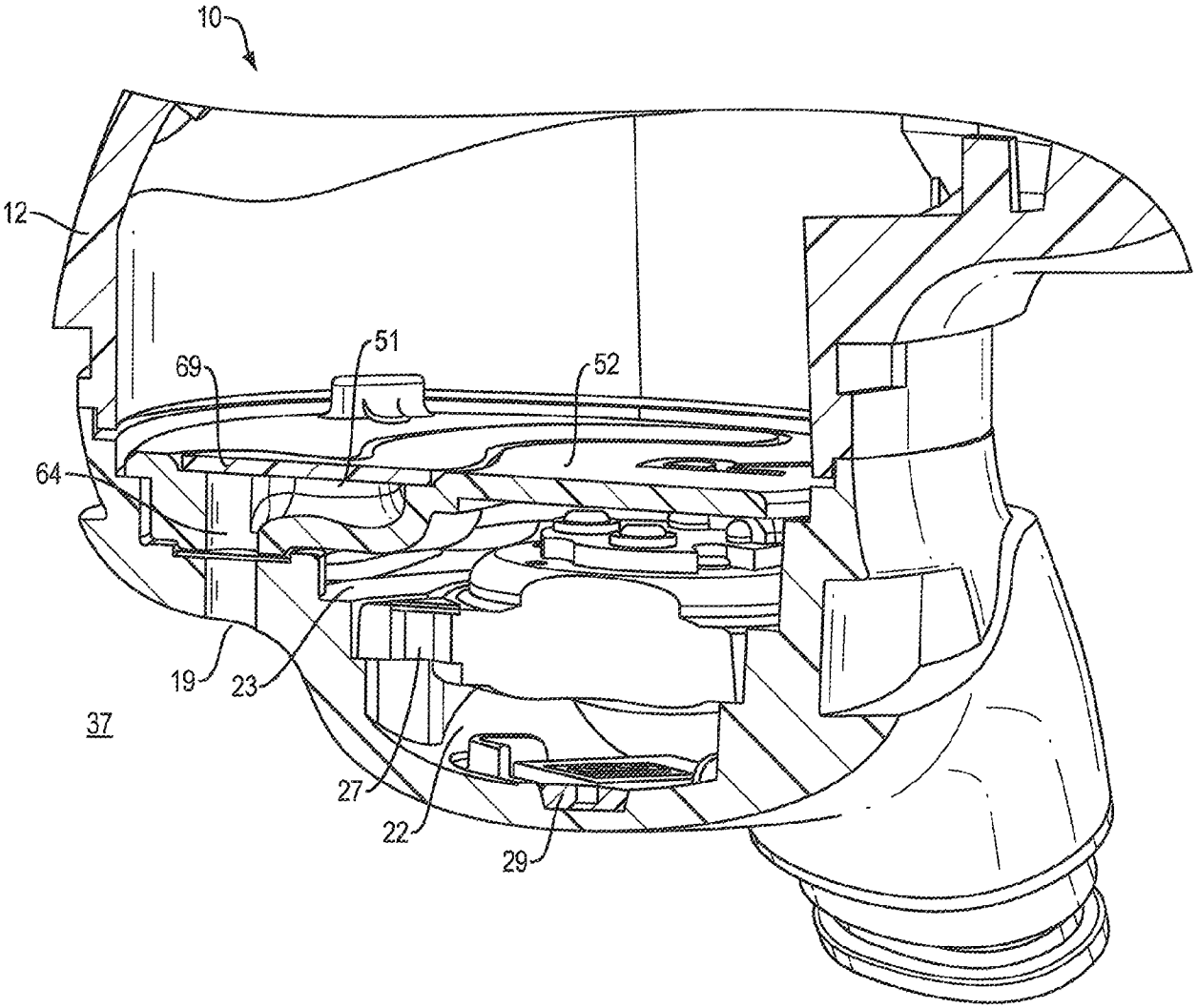
FIG. 2C is a cross-sectional view of an earphone.

FIGS. 2B and 2C illustrate additional aspects of earbud 10, including mass port opening 53 that is open to (i.e., fluidly coupled to) rear cavity 23, and mass port opening 64 that is fluidly coupled to external environment 37 via housing opening 19. Microphone 26 is located in nozzle 20 and is used in an acoustic noise cancellation system, as is known in the art. Microphone 29 is located in front cavity 22 and is used in an acoustic noise cancellation system, as is known in the art. Internal pressure equalization port 27 fluidly connects front cavity 22 and rear cavity 23, thereby creating an acoustic path from external environment 37, through the mass port, through the rear cavity, through the front cavity and thereby into the nozzle and the ear canal. Pressure equalization ports in earbuds are known in the technical field and so are not further described herein.

Mass ports in earbuds are sometimes configured as relatively long, thin, tubes. In an example, a mass port tube in an existing earbud has a length of about 12 mm and a diameter of about 0.5 mm. Due to boundary layer effects, at very low frequencies the air in the tube may not be able to move in and out of the tube. If the air does not move in and out of the mass port the port may be considered to be damped or attenuated, which can lead to the user feeling an occlusion effect. Such unrelieved pressure in the ear canal can be annoying or even uncomfortable for the user. For example, very low frequency vibratory sounds due to a user's footsteps may be conveyed to an earbud at frequencies of around 2-6 Hz. If the mass port is occluded at these frequencies the user will feel/hear pressure in the ear at this 2-6 Hz frequency.

In the present disclosure the diameter of the mass port for an earbud is increased such that air can move along and in and out of the port even at frequencies of 2-6 Hz. In an example the diameter is increased to about 1 mm, which allows for air flow in and out of the port even at frequencies of 2-6 Hz. The acoustic mass of a mass port has a substantial impact on its reactance, which in turn has an impact on the tuning of the rear acoustic cavity to which the mass port is acoustically coupled. Thus, in order for the tuning to remain the same it is necessary to at least approximately maintain the acoustic mass of the port. If the length is increased from about 12 mm to about 18-19 mm while the diameter is increased from 0.5 mm to 1 mm, the acoustic mass of the port will remain about the same. However, earbuds are small by necessity. For example, an earbud may have a maximum width of about 16 mm. Accordingly, a straight port tube of 18-19 mm cannot fit in such an earbud. In the present disclosure the port tube is curved along its length, so that its length can be greater than the width of the earbud. In the example of earbud 10, and as further explained below, the mass port has a general "S"-shape, with two curves along its length between its open ends 53 and 64. In other examples the mass port tube is curved along its length in a different manner. For example, the mass port can have a general "C"-shape or "L"-shape or "G"-shape.

Also, it is useful for the mass port tube to be designed such that there is a relatively constant air velocity across the diameter of the tube, excluding boundary layer effects. A constant velocity will help achieve desired airflow, even at low frequencies. It has been found that such a constant air velocity can be accomplished by either or both of: varying the cross-sectional area of the port tube along its length, and creating a bank in at least one of the curved sections of the tube.

Figure 3A:
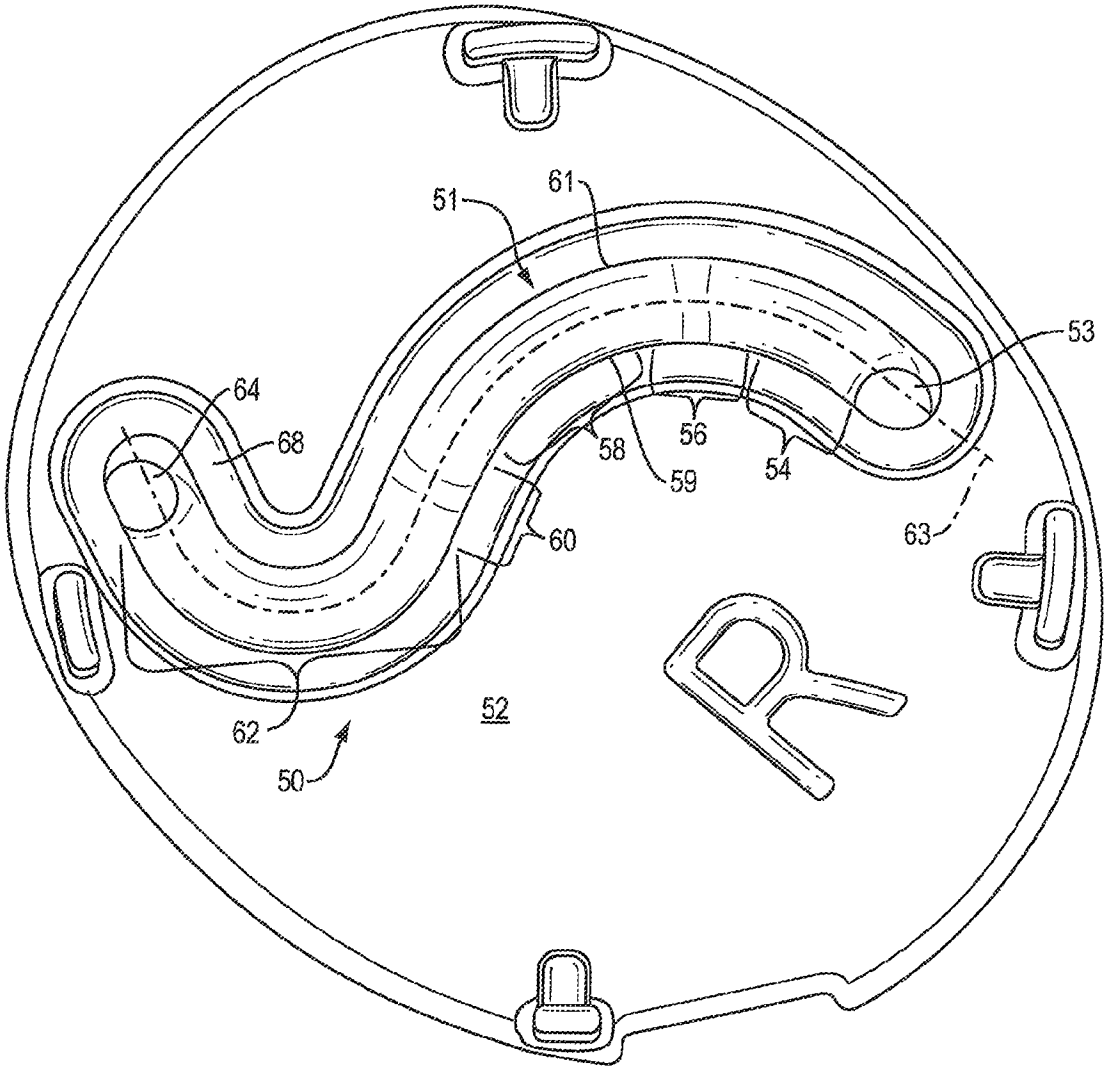
FIG. 3A is a top view of an interior dividing plate for an earphone, illustrating a channel formed in the interior dividing plate, where the channel forms part of an earphone port.
Figure 3B:
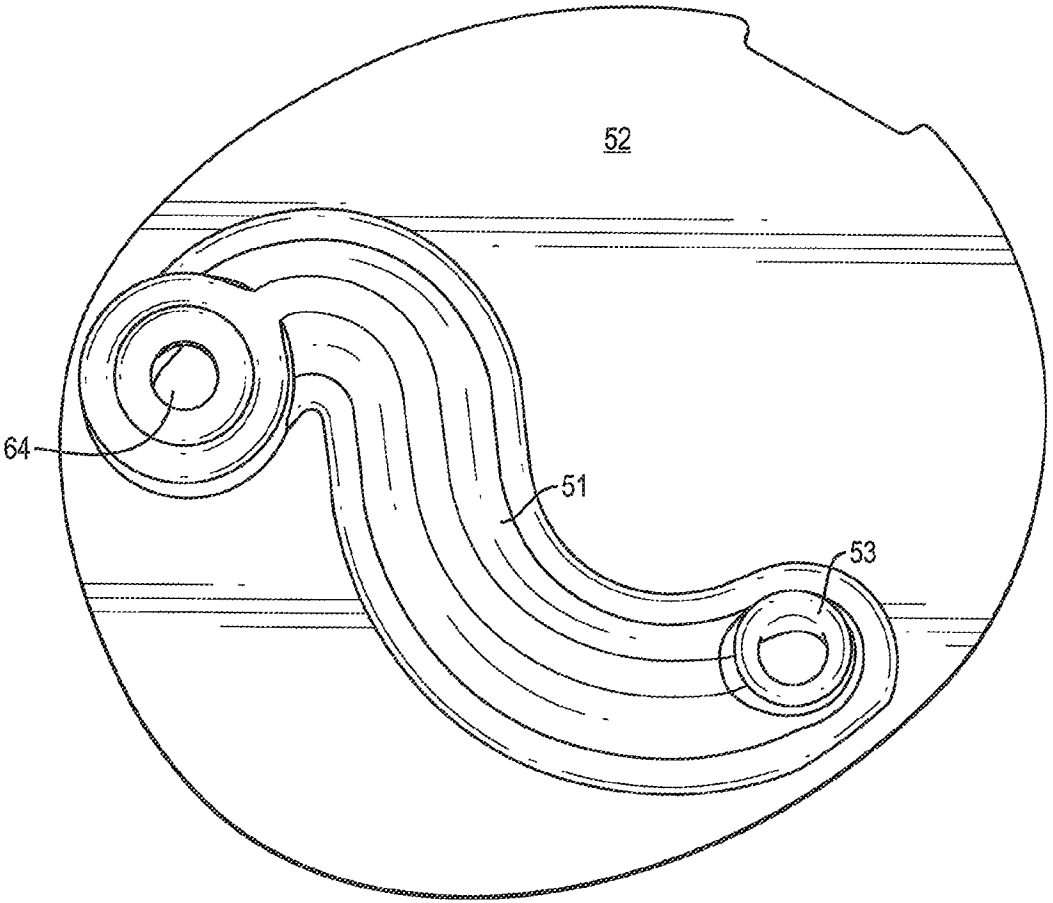
FIG. 3B is a bottom view of the plate illustrated in FIG. 3A.

In an example illustrated in FIGS. 3A (top view) and 3B (bottom view), a mass port 50 includes a channel 51 formed in plate 52. Opening 53 is configured to be fluidly coupled to the rear acoustic cavity and opening 64 is configured to be fluidly coupled to the external environment (e.g., by interfacing to an opening in the earphone housing). Depression 68 that is adjacent to and runs along the entire length of channel 51 receives a flat plate 69 (FIGS. 2A-2C) that covers channel 51 and so closes port 50 except for openings 53 and 64.

Channel 51 (and thus the mass port) lies along central longitudinal axis 63. Channel 51 includes a first, curved, section 54 that is proximate the earphone rear acoustic cavity 23 and defines a first cross-sectional area, which in some examples is about 1 $mm^2$. Second, transitional, section 56 is coupled to first section 54 and defines a gradually increasing cross-sectional area, which in some examples increases from about 1 $mm^2$ to about 1.12 $mm^2$. The gradual cross-sectional increase accomplished by transitional section 56 avoids a sharp increase in cross-sectional area and so leads to smoother, more laminar air flow.

In some examples the increase in cross-sectional area of the port is accomplished by increasing the depth of the port, as measured from the surface of depression 68. In some examples the depth increase is in the inner radius of a curve of the port, for example in inner wall 59 (as opposed to outer wall 61), creating a banking feature. The locations of the depth increases can be elsewhere along the length of the port, with a goal being smooth air flow that is constant across the width of the port and along its length.

Third, curved and banked, section 58 is coupled to the second section and defines a second cross-sectional area that is greater than the first cross-sectional area. In some examples this second cross-sectional area is about 1.12 $mm^2$. A fourth, transitional, section 60 is coupled to the third section 58 and defines a gradually decreasing cross-sectional area, which in an example is essentially the opposite of the gradually increasing area of transitional section 56. A fifth, curved, section 62 is coupled to the fourth section 60 and defines a cross-sectional area that it less than the cross-sectional area of section 58.

In some examples transitional sections 56 and 60 each transition approximately the same amount in cross-sectional area. In some examples each transitional section has a desired change in port cross-sectional area along its length, for example a linear or constant change per length unit, or otherwise. The change in cross-section in some examples depends in part on the curvature and slope of the port before and after the transitional section. A desired result is to accomplish a smooth transition in port cross-sectional area, resulting in a smooth air flow through the transitional section.

In some examples the tube has an approximately constant width along its length, which in one example is about 1.22 mm. In some examples the cross-sectional areas of sections 54 and 62 are the same. The cross-sectional area of section 58 is the largest of all the sections. In some examples and as shown in FIG. 3A, the radius of curvature of the longitudinal port axis along section 62 is smaller than that of sections 58 and 54. In some examples the radii of curvature of the longitudinal port axis along sections 54 and 58 are about the same.

Figure 4A:
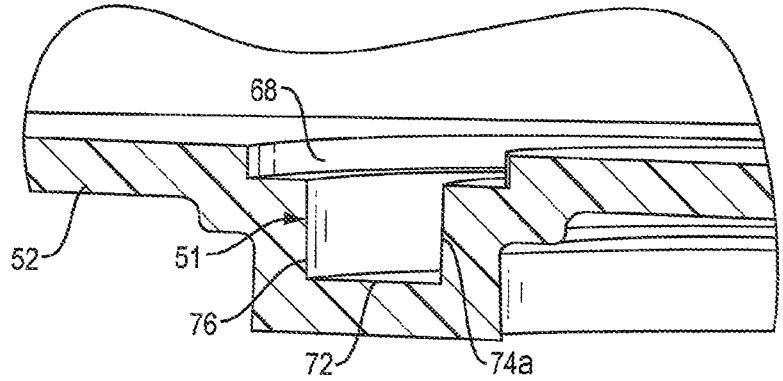
FIGS. 4A and 4B are cross-sections through different locations of an earphone port.
Figure 4B:
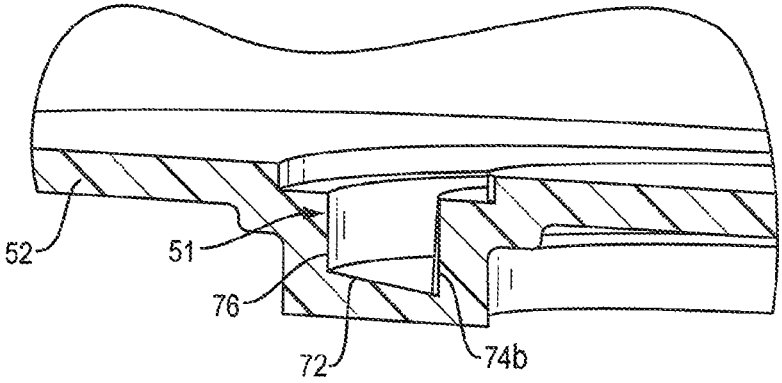

FIG. 4A is a cross-section through channel 51 in an un-banked portion of the mass port, wherein inner sidewall 74*a* and outer sidewall 76 have the same length measured from the lower surface of depression 68; this makes bottom wall 72 parallel to the lower surface of depression 68. FIG. 4B is a cross-section through channel 51 in a banked portion of the mass port, wherein inner sidewall 74*b* is longer than outer sidewall 76; this creates a bottom wall 72 that is angled relative to the lower surface of depression 68. In an example in the banked section(s) the length of the inner channel wall is increased by about 0.2 mm (e.g., its length can be increased from about 0.91 mm to about 1.11 mm, which is an increase of just over 20 percent). In some examples the width of the channel is constant along its entire length. In some examples this width is about 1.22 mm.

Figure 5:
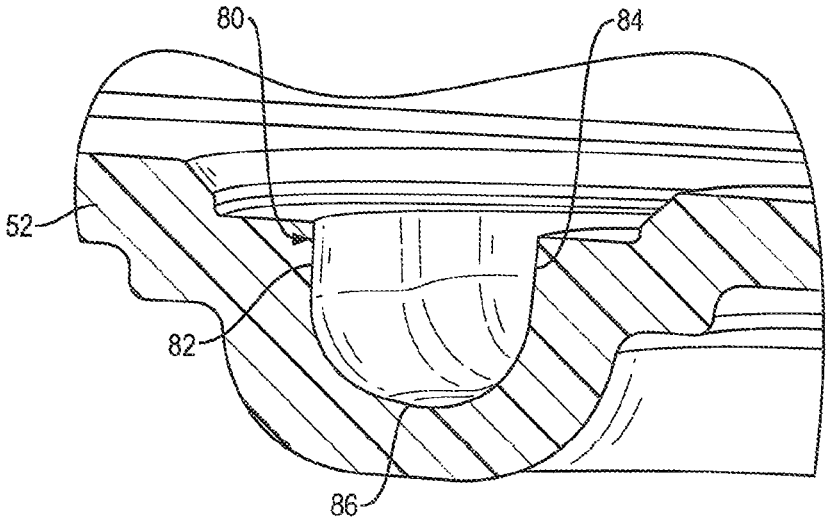
FIG. 5 is a cross-section through another earphone port.

In some examples, and as illustrated in FIG. 5, the otherwise sharp corners between the sidewalls and the bottom wall are blended. For example, channel 80 includes curved inner wall 84 and curved outer wall 82 that smoothly blend into lower wall 86. Such blending can help to achieve a more laminar, smooth, air flow profile in both banked and un-banked sections.

Figure 6:
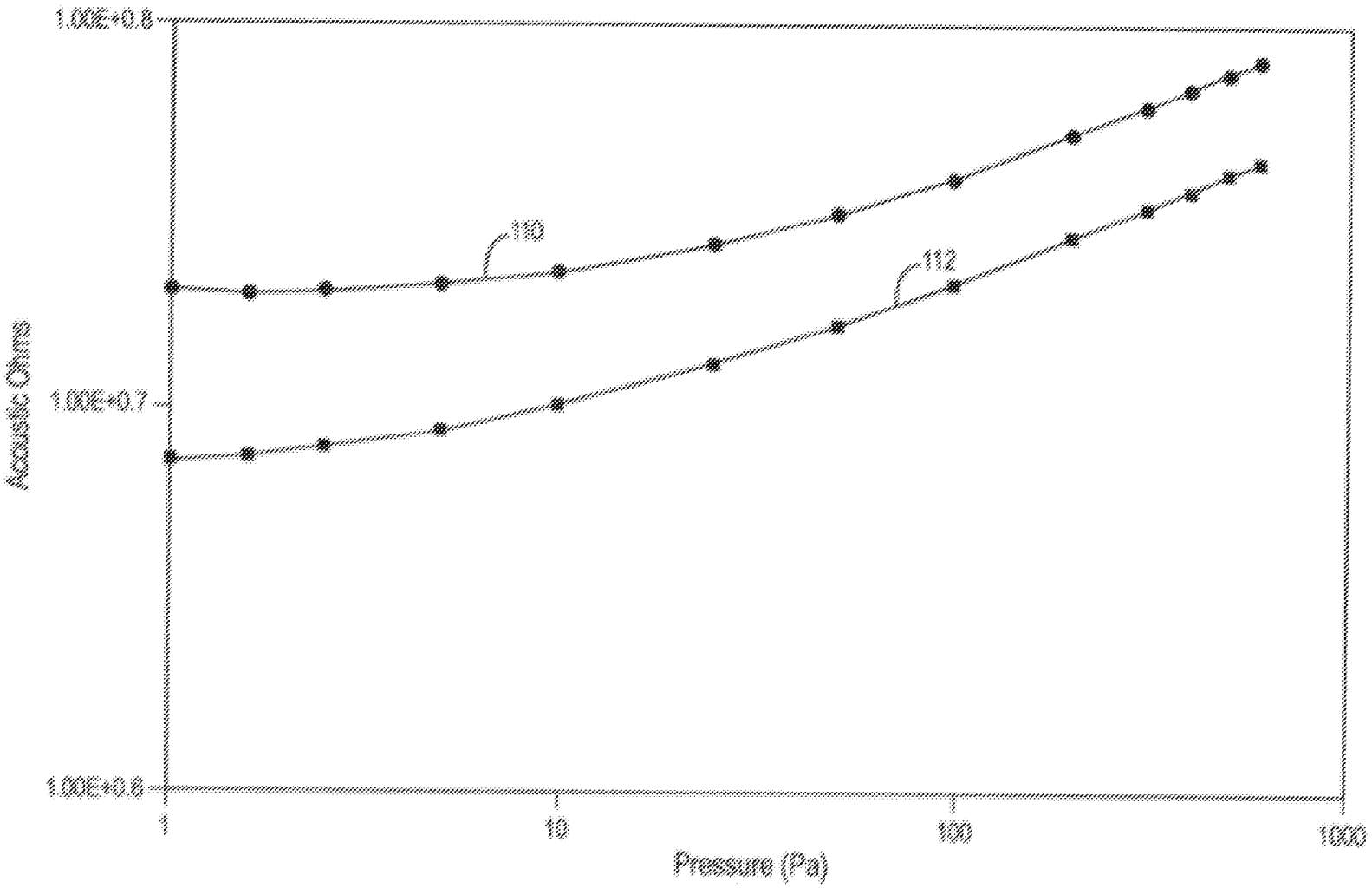
FIG. 6 is a plot of flow resistance vs. pressure for an earphone port of the present disclosure in comparison to a standard earphone port.

FIG. 6 is a plot of flow resistance (in acoustic ohms) vs. pressure (in Pa) for a prior mass port (plot line 110) and a mass port of the present disclosure, such as that shown in FIG. 3A, plot line 112. As may be observed, the increased cross-sectional area of the present mass port, accomplished with maintenance of the acoustic mass of the port, exhibits substantially lower flow resistance, which leads to better flow at low frequencies and so less of a feeling to the user that the earbud is occluded.

Having described above several aspects of at least one example, it is to be appreciated various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

What is claimed is:

1. A port tube for an earphone, wherein the port tube is configured to acoustically couple a rear acoustic cavity of the earphone to an external environment, the port tube comprising:

a first section that is proximate the rear cavity and defines a first cross-sectional area;

a second, transitional, section that is coupled to the first section and defines a gradually increasing cross-sectional area;

a third, curved and banked, section that is coupled to the second section and defines a second cross-sectional area that is greater than the first cross-sectional area;

a fourth, transitional, section that is coupled to the third section and defines a gradually decreasing cross-sectional area; and a fifth section that is coupled to the fourth section and defines a third cross-sectional area that it less than the second cross-sectional area.

2. The port tube of claim 1, wherein the first section is curved.

3. The port tube of claim 2, wherein a radius of curvature of a central longitudinal axis of the first section is approximately the same as a radius of curvature of the central longitudinal axis of the third section.

4. The port tube of claim 1, wherein the second and fourth sections each transition approximately the same amount in cross-sectional area.

5. The port tube of claim 1, wherein the third section comprises an inner wall and an outer wall, and wherein the banking is between the inner wall and the outer wall.

6. The port tube of claim 5, wherein the third section further comprises a lower wall that meets the inner wall and the outer wall.

7. The port tube of claim 6, wherein the banking comprises the inner wall being longer than the outer wall.

8. The port tube of claim 7, wherein the banking comprises the inner wall having a length that is about 20 percent greater than that of the outer wall.

9. The port tube of claim 1, wherein the fifth section is curved.

10. The port tube of claim 9, wherein a radius of curvature of a central longitudinal axis of the fifth section is smaller than is a radius of curvature of a central longitudinal axis of the third section.

11. The port tube of claim 1, wherein the port tube is generally "S"-shaped along a length thereof between a first end where the port tube is fluidly coupled to the rear acoustic cavity of the earphone and a second end where the port tube is fluidly coupled to the external environment.

12. The port tube of claim 11, wherein the "S"-shape defines a first curve closest to the first end and a second curve closest to the second end.

13. The port tube of claim 12, wherein the first curve has a radius of curvature of a central longitudinal axis of the port tube that is greater than a radius of curvature of a central longitudinal axis of the second curve of the port tube.

14. The port tube of claim 1, wherein the second cross-sectional area is approximately 12 percent greater than the first cross-sectional area.

15. The port tube of claim 1, wherein the tube has a length dimension along its length and a width dimension across its width that is orthogonal to its length, and wherein the width dimension is approximately the same along the entire length dimension.

16. The port tube of claim 1, wherein the first, third, and fifth sections each have a constant cross-sectional area along lengths thereof.

17. The port tube of claim 16, wherein the cross-sectional areas of the first and fifth sections are the same, and the cross-sectional area of the third section is greater than that of the first and fifth sections.

18. A port tube for an earphone, wherein the port tube is configured to acoustically couple a rear acoustic cavity of the earphone to an external environment, the port tube comprising:

a first, curved, section that is proximate the rear cavity and defines a first cross-sectional area;

a second, transitional, section that is coupled to the first section and defines a gradually increasing cross-sectional area;

a third, curved and banked, section that is coupled to the second section and defines a second cross-sectional area that is greater than the first cross-sectional area, and comprising an inner wall, an outer wall, and a lower wall that meets the inner wall and the outer wall, and wherein the banking comprises the inner wall having a length that is greater than a length of the outer wall;

a fourth, transitional, section that is coupled to the third section and defines a gradually decreasing cross-sectional area; and a fifth, curved, section that is coupled to the fourth section and defines a third cross-sectional area that it less than the second cross-sectional area;

wherein the second and fourth sections each transition approximately the same amount in cross-sectional area;

wherein the tube has a length dimension along its length and a width dimension across its width that is orthogonal to its length, and wherein the width dimension is approximately the same along the entire length dimension; and wherein the first, third, and fifth sections each have a constant cross-sectional area along lengths thereof, wherein the cross-sectional areas of the first and fifth sections are the same, and the cross-sectional area of the third section is greater than that of the first and fifth sections.

19. The port tube of claim 18, wherein a radius of curvature of a central longitudinal axis of the fifth section is smaller than is a radius of curvature of a central longitudinal axis of the third section.

20. The port tube of claim 19, wherein the second cross-sectional area is approximately 12 percent greater than the first cross-sectional area.

* * * * *